United States Patent [19]

Pinette

[11] 4,212,241

[45] Jul. 15, 1980

[54] PROCESS OF EXTRACTING JUICE FROM A SAMPLE OF LIQUID-CONTAINING MATTER SUCH AS SUGARCANE AND AN EXTRACTOR PRESS

[75] Inventor: Gérard Pinette, Givry, France

[73] Assignee: Pinette-Emidecau S.A., Chalon sur Saone, France

[21] Appl. No.: 963,101

[22] Filed: Nov. 22, 1978

[30] Foreign Application Priority Data

Nov. 28, 1977 [FR] France ..... 77 35692

[51] Int. Cl.[2] ..... B30B 9/06; B30B 15/02

[52] U.S. Cl. ..... 100/116; 100/37; 100/223

[58] Field of Search ..... 100/37, 116, 125-129, 100/218-225, 264, 244, 295

[56] References Cited

U.S. PATENT DOCUMENTS

| | | | |
|---|---|---|---|
| 1,360,206 | 11/1920 | French et al. | 100/244 X |
| 2,904,835 | 9/1959 | Thomas | 100/116 X |
| 3,304,855 | 2/1967 | Oebell | 100/223 X |

*Primary Examiner*—Edward J. McCarthy
*Attorney, Agent, or Firm*—Diller, Ramik & Wight

[57] ABSTRACT

An extractor press disclosed comprises an upright frame having a plurality of posts, a drum mounted for angular displacements around one of the posts and having a plurality of equidistant sample loading and juice extraction work stations. Each work station has a coaxial filter cup and juice receptacle assembly, a lower hydraulic cylinder having a piston adapted to raise the assembly during compression, and a central ejection rod. An operating station is fixed to the frame and comprises a motor for the rotation of the drum and an upper precompression hydraulic cylinder having a piston for displacing the removable ramming member in the filter cup and a latch for locking the ramming member in position in the filter cup and an ejecting hydraulic cylinder selectively cooperable with the central ejection rod.

38 Claims, 6 Drawing Figures

PROCESS OF EXTRACTING JUICE FROM A SAMPLE OF LIQUID-CONTAINING MATTER SUCH AS SUGARCANE AND AN EXTRACTOR PRESS

FIELD OF THE INVENTION

The present invention relates, in its first aspect, to a process of extracting juice from a sample of liquid-containing matter, such as sugarcane, for qualitative or quantitative analytical sampling, and in its second aspect to a juice extractor press for carrying out such a process.

In the detailed description the process of extracting juice and the corresponding extractor press are disclosed herein in relation to the analysis of sugarcane samples; it will be readily understood that such an application is in no way intended to be a restriction and that the present process and extractor press are suitable for use with other liquid-containing matter.

BACKGROUND OF THE INVENTION

The objective of extraction is to expel or squeeze the juice from a sample of sugarcane, representative of a load for delivery to a sugar mill and/or refinery in order to determine, before purchase, the sugar content of the load of sugarcane. The so-called press method has the advantage of providing high speed analysis and exceptional accuracy in the reproducibility of its analyzing cycles.

The pressure exerted on a sample of sugarcane placed in a perforate filter cup, also known as the bucket, is maintained at a strictly constant maximum value for a predetermined period, so as to ensure the extraction of nearly all the juice contained in the sugarcane.

The juice is analyzed physically to determine the saccharine content. The remaining "cake" of bagasse or megass is weighed. The weight of the bagasse and the amount of sugar are the two parameters taken into consideration for calculating the price paid to the grower for his sugarcane.

The extraction technique, the configuration and arrangement of the perforate filter cup, the shape of the perforations, etc., are designed so that not only as much as possible of the juice is extracted but also to prevent "reimbibition" or reabsorption of the juice back into the cake once the pressure exerted is released.

Present-day sample extractor presses are of simple design with two symmetrical handling stations and a vertically displaceable piston. The juice receptacle on which the removable perforate cylindrical filter cup is centered is attached to a movable carriage which has two end of course positions, a pressing position and a retracted position for loading surgarcane sample and ejecting the compressed depleated cake.

The cake, though, is held in the bottom of the filter cup. It is therefore necessary to dislodge it to cause it to drop to a drawer provided on each work table.

As a trade-off to the low cost and easy operation of the extractor press are its various drawbacks, inter alia, the handling of filter cup which is a tiresome operation for the operator; the impossibility of loading the filter cup when it is not in the receptacle; the ejecting of the cake by hand; and the low operating speed or hourly output.

The full operating cycle takes three and a half minutes of which the pressing of the sample lasts a total of two minutes which limits the hourly rate to a maximum of 17 analyses per hour.

SUMMARY OF THE INVENTION

The object of the present invention is to provide a process for extracting juice and an extractor press which may operate at high rates of production under industrial conditions.

The idea behind the invention is to take advantage of the mandatory compression period (e.g. two minutes) for carrying out the loading of the sample and the ejection of the cake which steps are therefore performed in otherwise dead time.

According to the invention, there is provided for a process of extracting juice from liquid-containing sample for analysis, comprising extracting the juice from the sample including the successive steps of precompression or consolidation and compression of the opposed sides of the sample, a plurality of combined mobile work stations for loading samples and extracting juice, each such mobile work station having independent compression and ejection means and being displaceable during extraction so as to come into position at a single operating station provided with precompression and cake ejection control means.

This arrangement of a plurality of loading and extraction work stations selectively cooperating with a single operating station affords the major dual advantage of the present invention, e.g., enhanced hourly output and elimination of handling the filter cup.

Advantageously the precompression or consolidation step is accomplished by means of a ramming member bearing against the top side of the sample and adapted to be locked in its compression position while the actual compression step is performed on the bottom side of the sample by the combined movement of the filter cup and the juice receptacle, the ramming member serving as a reaction means in conjunction with the table of the press.

The ramming member at the top side thus utilized for consolidating or precompressing the sample also simplifies the subsequent compression step.

According to a preferred embodiment of the extractor press there is provided an upright frame having a plurality of posts, a drum mounted for angular displacements around one of said posts and having a plurality of equidistant sample loading and juice extraction work stations, each said station having a coaxial filter cup and juice receptacle assembly, a lower hydraulic cylinder having a piston adapted to raise the assembly during compression, and a central ejection rod; an operating station fixed to the frame and including motor means for the rotation of the drum; an upper precompression hydraulic cylinder having a piston for displacing the removable ramming member in the filter cup and means for locking said ramming member in position in said filter cup and in ejecting hydraulic cylinder selectively cooperable with said central ejection rods.

It will be readily appreciated that such an extractor press may be highly automated, thereby eliminating substantially all or all manual operations.

Other features of the invention will become apparent from the description which follows, given strictly by way of example, of a preferred embodiment, with reference to the accompanying drawings. CL BRIEF DESCRIPTION OF THE DRAWINGS FIG. 1 is a simplified perspective view of an extractor press embodying the present invention;

DETAILED DESCRIPTION OF THE PREFERRED EMBODIMENT

The description will be limited, for the sake of simplicity and brevity, to the actual features of the present invention. In fact various details determined by the particular application (sugarcane industry) or inherent in hydraulic presses in general (e.g. safety devices, limit switches) are well known to those skilled in the art and will not be described in detail even though some may be visible in certain figures of the drawings.

Figure 1:
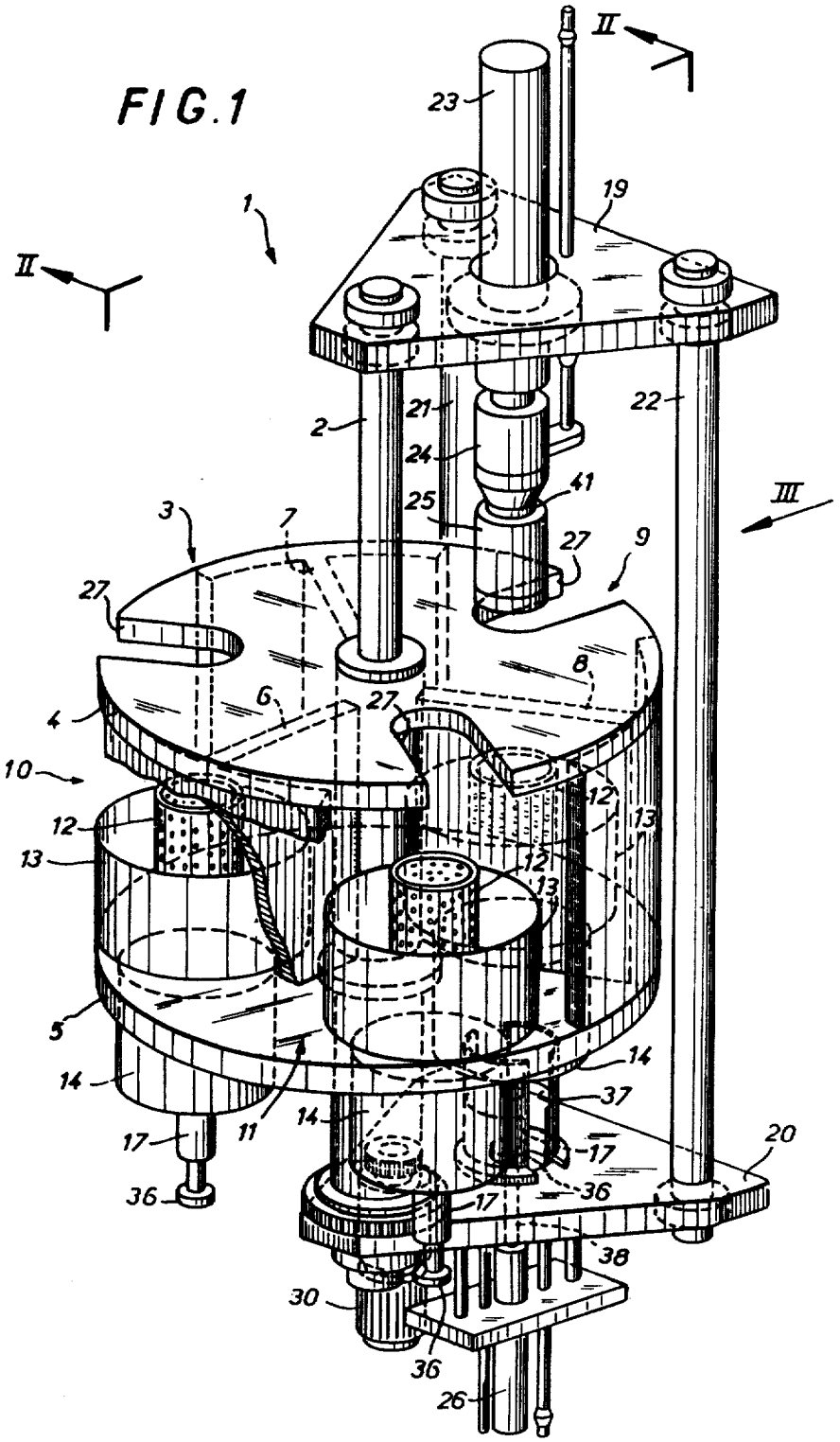

Reference will first of all be made to FIG. 1 which illustrates the main parts of the extractor press according to the invention. On one of the posts 2 of the three-posted frame of the extractor press 1 is mounted for rotation a drum 3 made up of two round plates 4,5 interconnected by radial partitions or spacers 6,7,8. The parts of the drum 3 may be mechanically welded and thus form the body of the press of which the top plate 4 is the bearing member.

Figure 3:
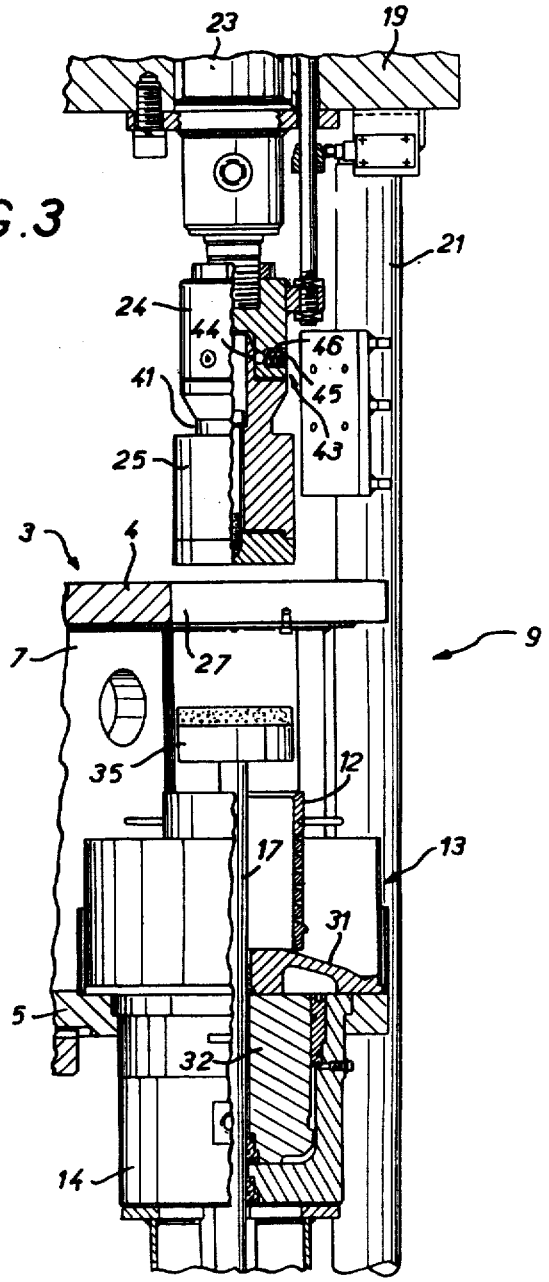
FIG. 3 is a more detailed view, partly in section of central part according to FIG. 2.

The three radial partitions 6, 7 and 8 define compartments accommodating extracting and loading stations, referred to as work stations and denoted by the general reference numerals 9,10 and 11. Each of the work stations comprises, above the lower plate 5 a juice collecting receptacle 13 in which the perforate filter cup 12 is centrally located, and below the plate 5 along the axis of the filter cup/receptacle assembly, a hydraulic cylinder 14 assigned to one of the extraction stations 9,10,11. Ejection means comprising an axial ejector member or rod 17 is connected to the bottom end wall 35 of each filter cup 12 (FIG. 3).

In the illustrated embodiment the frame 1 comprises two upper and lower plate members 19,20 of triangular configuration which are traversed not only by post 2 carrying the drum 3 but also the other two posts 21,22. A so-called precompression or consolidating hydraulic cylinder 23 is mounted on the upper plate member 19 and comprises a piston member 24 which has removably secured thereto a ramming member 25. Aligned with the hydraulic cylinder 23 is another hydraulic unit 26 mounted on the lower plate member 20, adapted to actuate the ejector member 17. This station will be referred to hereinafter as the operating station.

The upper plate 4 of the drum is provided with three openings (slots for example) 27 which are precisely in alignment with each of the loading and extraction or work stations 9,10 and 11.

As the drum is rotated stepwise each of the loading and extraction or work stations 9,10, and 11 therefore successively comes into alignment with or positioned at the operating station so that the ramming member 25—as explained hereinafter there is one ramming member for each work station—is thrust into its filter cup at the associated work station 9,10,11.

The motor means is generally denoted by reference numeral 30 and includes an electric motor and reducing gear mechanism for rotating the entire drum 3 through predetermined angular displacement, thereby displacing the work stations in unison.

Figure 2:
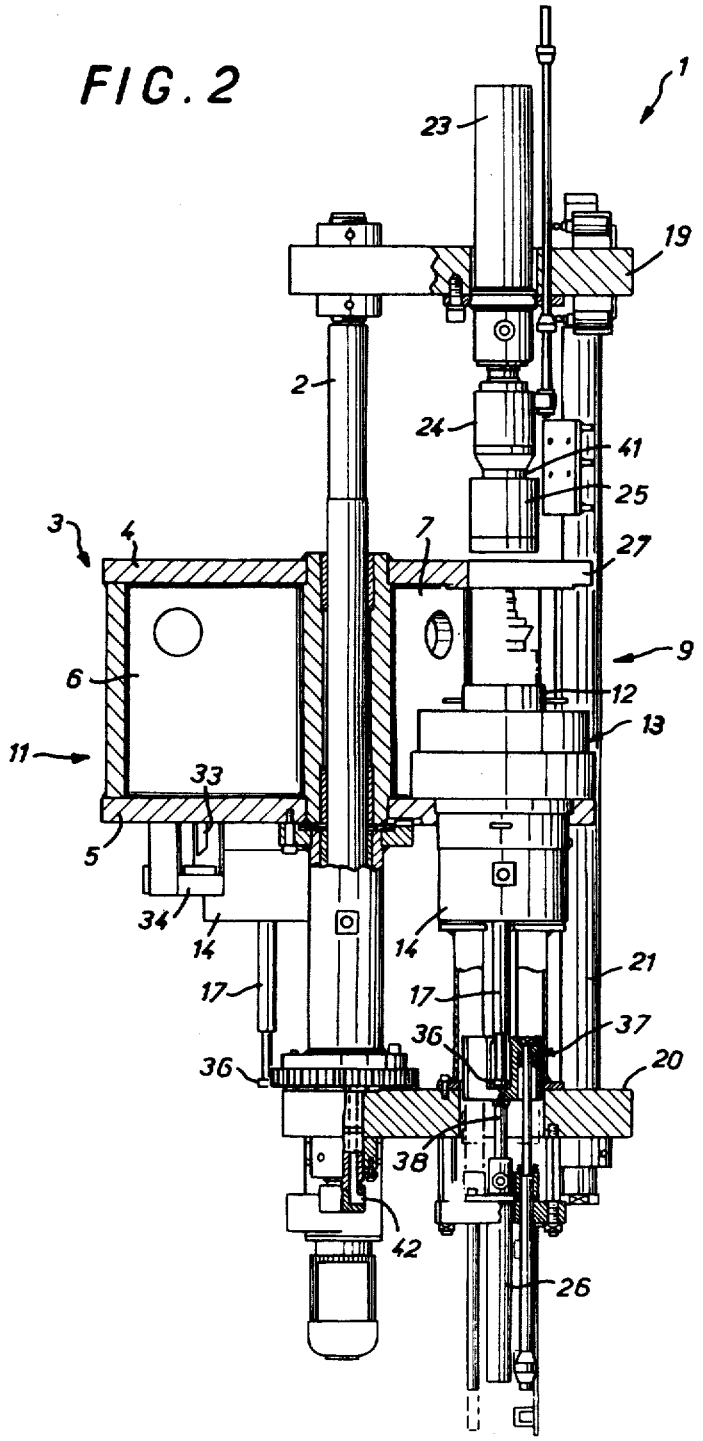
FIG. 2 is an elevation view, partly in section taken on line II—II in FIG. 1.
Figure 4:
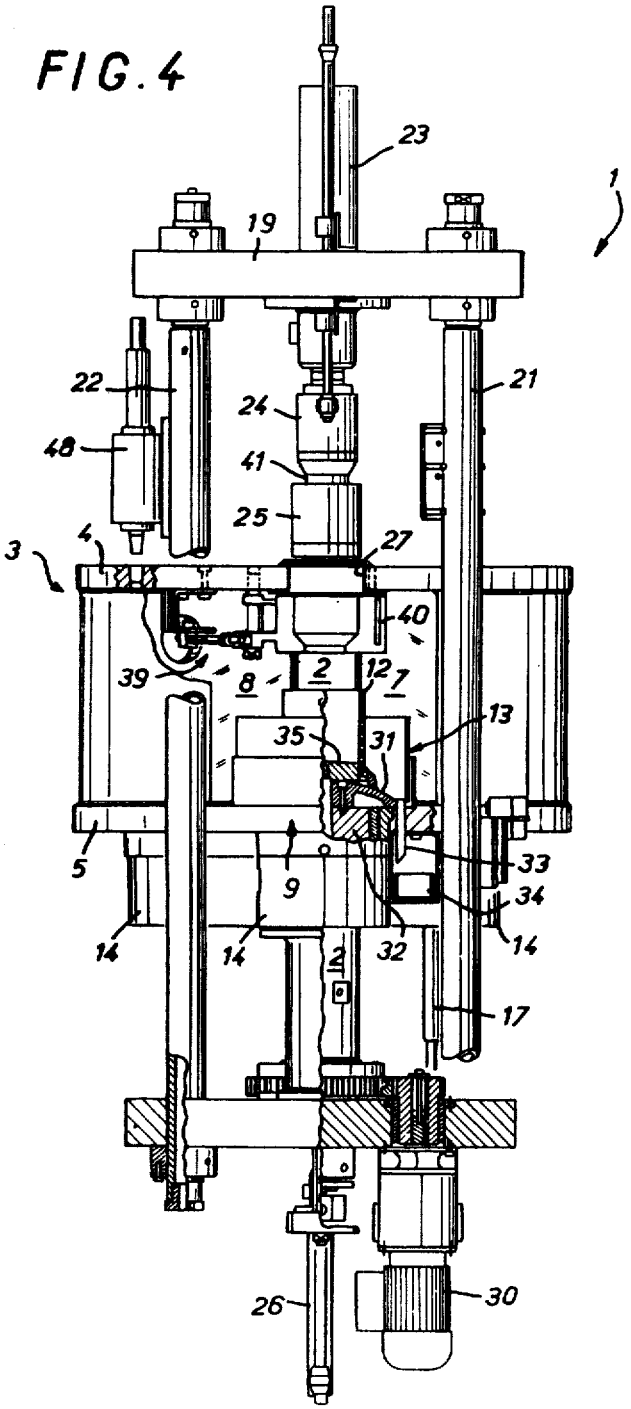
FIG. 4 is a view similar to that of FIG. 2 viewed in the direction of arrow III in FIG. 1, with parts broken away.

Reference will now also be made to FIGS. 2, 3 and 4 with a view to describing various details of the operating station as well as the work stations, only one of which will be described in detail as all three are substantially identical.

FIGS. 3 and 4 illustrate the disposition of the filter cup/receptacle assemblies on the associated lower piston head 31.

In FIGS. 2, 3 and 4 the work station 9 is in alignment with the operating station; the receptacle 13 and the filter cup 12 rest on a piston member comprising a piston head 31 associated with piston 32, the surface of the piston head tapering from the center so as to ensure that the juice extracted from the sample runs out of the filter cup 12 into the receptacle 13 from where it is discharged through an outlet 33 to be collected in a beaker member 34 (FIG. 2). Each filter cup 12 includes a movable bottom wall 35 attached to the ejector member 17 which has an enlarged terminal portion 36 which is adapted to be received in a yoke 37 fixed to the piston 38 of the ejecting hydraulic cylinder 26, when the filter cup 12 and the rest of its associated work station are at the operation station.

Figure 5:
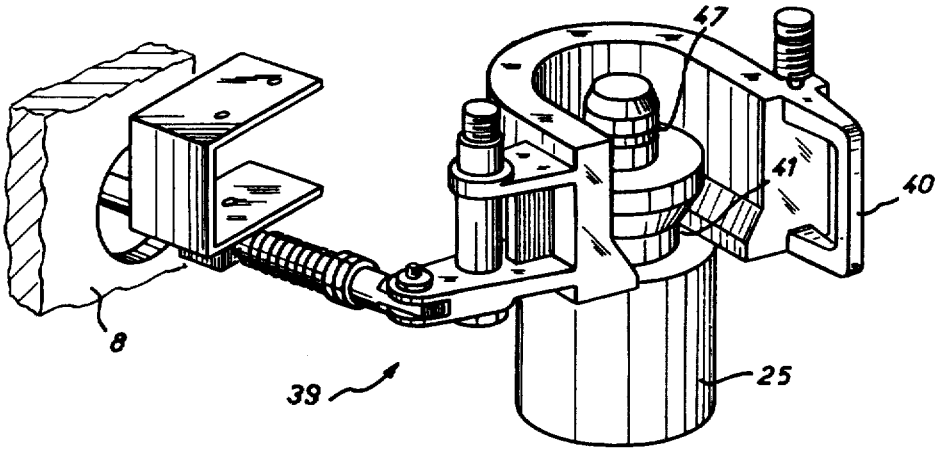
FIG. 5 is a perspective view of the latching member 39 in FIG. 4.

A generally C-shaped latching member 39 (FIGS. 4 and 5) pivotally mounted under the upper plate 4 of the drum 3 is adapted to lock the ramming member in its compression position in the filter cup 12 at the operating station. In the illustrated embodiment the latching member 39 is adapted to be controlled manually by a handle 40, the ramming member 25 having a complementary annular groove 41 for engaging the latching member 39 and securing the ramming member against displacement. The ramming member and latching member together bear against the upper plate 4 which provides the reaction force to the active force developed in the lower hydraulic cylinder 14 in the course of compression.

The lower hydraulic cylinders 14 mounted on lower plate 5 are supplied at 42 through central post 2.

In FIG. 1 the ramming member 25 is shown detachably secured to the piston member 24 of the associated upper hydraulic cylinder 23. The ramming member 25 is adapted to be locked in the filter cup 12. In FIG. 3 is represented a retaining means 43 suitable for releasably securing the ramming member to the upper cylinder piston 24; nonetheless any other manual, semi-automatic or automatic means may also be employed.

The releasable retaining means 43 comprises, as best seen in FIG. 3, a plurality of retaining balls 44 of which only one is visible biased radially inwardly by coil springs 45 accommodated in radial bores 46 in the piston member 24. In the retaining position as shown in FIGS. 2 and 3, the balls are engaged in the annular or part annular grooves 47 along the periphery of an upward axial projection of its associated ramming member 25 to secure the ramming member in position on the piston member 24 of the upper precompression cylinder 23. The force of the spring is determined so that the retaining balls securely retain the ramming member 25 on the piston member 24 for raising and lowering the same, without unduly retaining the ramming member 25 once it is locked in position on its filter cup 12 by latching member 39 and the piston member 24 is to be raised to its top end of stroke position.

The main parts of the extractor press thus being described, the operating cycles of the extractor press will now be considered, starting from the rest position in which: the drum 3 reposes, one of the work stations 9,10,11 being in vertical alignment with the operating station; the lower hydraulic cylinder 26 being at its bottom end of stroke position; the upper hydraulic cylinder 23 being at its top end of stroke position, the ramming member 25 secured to the associated piston member 24; the ejection hydraulic cylinder 26 at its bottom end of stroke position; and the latching member 39 in its retracted position, out of engagement with the groove 41 in the ramming member 25. In the rest position the work station is freely accessible to the operator for manual loading or to an automatic loader.

I. The loading and precompression or consolidation of the work station in position at the operating station A sample of finely shredded sugarcane fiber is loaded in the filter cup. The upper hydraulic cylinder 23 is pressurized and the piston member 24 and therefore the ramming member 25 are driven downwards, the latter into the filter cup 12. The shredded sugarcane fiber is consolidated or precompressed to the densification value corresponding to the force exerted, the ramming member 25 being in a position whereas the latching member 39 is adapted to be received in the groove 41 of the corresponding ramming member. Once the ramming member 25 is manually or automatically locked into place the upper piston 24 may be returned to its retracted position which automatically releases the retaining means 43 previously securing the piston 24 to the ramming member 25, while the ramming member 25 remains locked in the filter member 12.

II. Angular displacement of the drum

Once the upper piston is withdrawn beyond the drum, the latter may be rotated through 120° by the motor means and reduction gear mechanism 30. Hydraulically operated locating pin means 48 (FIG. 4) are also provided to ensure that the displacement of the drum 3 through the inter work station angle is such that the work station is moved into perfect axial alignment with the fixed operation station. Failure to ensure perfect alignment could cause serious damage to the misaligned work station or even the entire extractor press. Concurrently the lower hydraulic cylinder 14 is pressurized. The consolidated sugarcane fiber is then highly compressed and its juice is extracted. Once the hydraulic pressure attains the preset maximum pressure it is held at that pressure for a length of time, clocked by a timer (not shown), which is normally two minutes.

III. Loading the precompression at a second work station

The drum having been displaced 120° another work station will be in position at the operating station at which the steps of stage I followed by those of stage II are performed.

IV. The loading and consolidation of the third work station

At this instant all three work stations are in operation.

V. Cake ejection followed by reloading

Once the drum has been rotated through 360° according to the present time program the work station which was at the operating station at the beginning is back to its initial position. This stage progresses as follows: The latching member 39 is retracted; the upper piston 24 is snapped into position on the ramming member 25 still in position in the filter cup 13; the bagasse cake held captive between ramming member 25 and the bottom 35 of the filter cup is removed by simultaneously raising the ramming member 25 and the movable bottom 35 of the filter cup 12. The ejector member 17 raises the bottom of the filter cup 12 under the action of the ejection control hydraulic cylinder 26. The upper piston 24 raises the ramming member 25 out of the filter cup 12.

The bagasse cake is thus lifted neatly, clamped between the movable bottom wall 35 of the filter cup 12 and the ramming member 25, which prevents its periphery from being frayed by the edge of the filter cup 12. The ramming member is carried upwards by the piston member 24 to its top end of stroke position so as to make the bagasse cake accessible to an automatic discharge device or simply the operator's hand who then removes the cake from the bottom wall 35 on which it is supported (FIG. 3). Thereafter, the ejection hydraulic cylinder 26 is retracted to its bottom end of stroke position, the bottom wall 35 of the filter cup 12 returning to its rest position on the piston head 31 of its compression hydraulic cylinder 14 at the same work station.

The next operating cycle can then commence with stage I.

Figure 6:
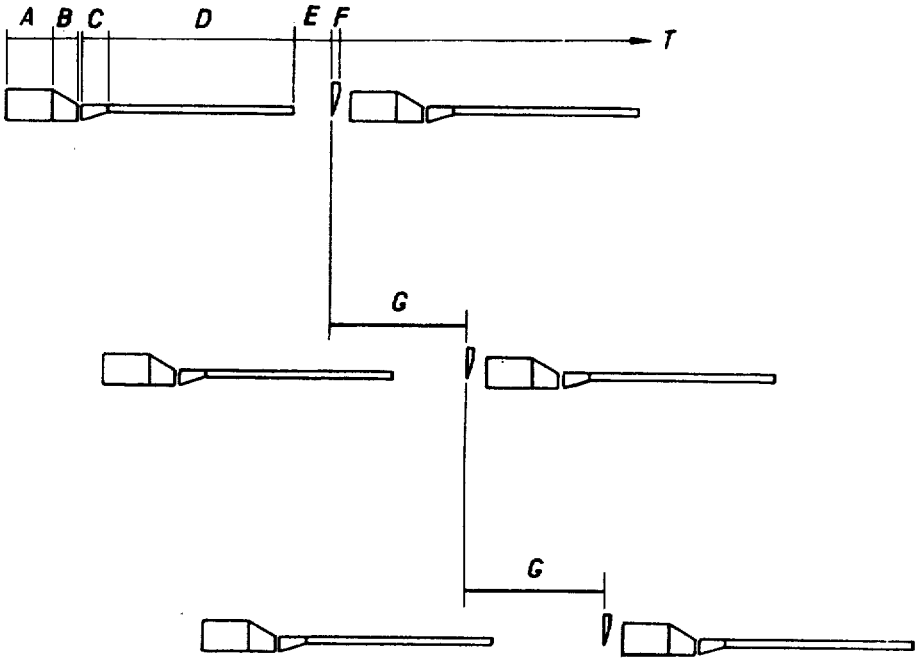
FIG. 6 is a diagram illustrating the operating cycle of the extractor press and the sequence of steps at each station.

The operating cycle is represented diagrammatically in FIG. 6 which illustrates the various stages of the operating cycle of the extractor press at each one of the work stations.

Time (T) is plotted along the horizontal axis and the pressure exerted against one of the sides of the sample is plotted on the vertical axis. This diagram is for an extractor press, as described, with three work stations. The following periods are lettered:

Period A is the loading of the filter cup;

Period B is the consolidation or precompression of the sugarcane fiber sample;

Period C is the compression of the consolidated cake;

Period D is the maintaining of the compression;

Period E the cake is held in position after the completion of extraction; and

Period F is the ejection of the bagasse cake;

Period G between two successive cake ejections gives the operating frequency of the press which is 90 seconds.

The invention is not intended to be limited to the specific embodiments of the process and extractor press disclosed herein, but rather includes all variations, alternatives and equivalents lying within the scope of the appended claims.

What I claim is:

1. In an extractor press having a plurality of work stations, means for selectively bringing the work stations individually and sequentially into position relative to a single operating station, each work station having its own sample compression means and juice evacuating means, and the single operating station having means operative cooperatively with each sample compression means for precompressing the sample and means for ejecting a depleted sample cake; the method comprising the steps of:

(a) loading a first work station in position at the single operating station with a sample of liquid-containing matter;

(b) precompressing the sample in the first work station at the single operating station utilizing the precompressing means of the single operation station;

(c) displacing the first work station away from the single operating station and bringing a second work station into position at the single operating station;

(d) repeating steps (a) and (b) with the second work station at the single operating station;

(e) beginning the compression of, and evacuation of juice from, the sample at the first work station subsequent to the precompression thereof and continuing compression and evacuation during step (d);

(f) eventually returning the first work station to the single operating station during the compression of, and evacuation of juice from, the sample at the second work station; and (g) ejecting the thus depleted cake from the first work station and reloading the first work station, and then precompressing a new sample therein again at the single operating station.

2. A method according to claim 1, wherein said precompression and said compression steps comprise effectively exerting forces against opposed sides of the sample.

3. A method according to claim 1, there being at least two work stations, wherein the other work station last to arrive at the single operating station relative to the first work station is precompressed before the first work station returns to the operating station.

4. A method according to claim 1, wherein said compression step is effected by locking a ramming member into position in a cup member accommodating a sample, throughout extraction.

5. A method according to claim 1, further comprising exerting an active force against the bottom end wall of the cup member during the compression step.

6. A method according to claim 4, wherein said ejection step comprises displacing the bottom end wall of the cup member together with the ramming member with the juice depleted sample cake sandwiched therebetween.

7. A method according to claim 2, wherein the precompression step comprises applying an active force in a first direction and the compression step comprises applying an active force in a direction parallel to but opposite the first direction.

8. An extractor press for samples of liquid-containing matter, comprising a plurality of work stations each including a cup member adapted to be loaded with a sample, said cup member being adapted to communicate with a receptacle for collecting juice extracted from a sample, means for selectively displacing the work stations individually and sequentially into and out of position at a single operating station, said single operating station including precompression means for precompressing a sample in a work station positioned at said single operating station, and compression means at each said work station for compressing the sample in its associated cup member subsequent to precompression at said single operating station, said single operating station also having means for ejecting a juice depleted sample cake from said cup member after compression of the sample and before loading a new sample into said work station at said single operating station.

9. An extractor press according to claim 8, further comprising ramming means for each work station releasably mountable on said precompression means, and means for locking said ramming means into position in its cup member after precompression of the sample therein.

10. An extractor press according to claim 9, said cup members having a removable bottom end wall, said ejection means in operation adapted to dislodge and expel the sample in a cup member at said operating station in cooperation with its associated ramming member, whereby the sample is lifted from its cup member clamped between the associated bottom wall and ramming member.

11. An extractor press according to claim 8, further comprising a drum member supporting said work stations for angular displacement about an axis and relative to said operating station, said work stations being uniformly spaced about the axis of said drum member.

12. An extractor press according to claim 8, wherein said cup member comprises a perforate side wall and a bottom end wall, the perforations in said side wall providing communication with said receptacle which is disposed around said cup member.

13. An extractor press according to claim 8, and a frame for said extractor press comprising a pair of vertically spaced apart plates interconnected by posts of which one defines the axis of rotation of said drum.

14. An extractor press according to claim 9, wherein said precompression means comprises a hydraulic cylinder having a piston member mounted for vertical displacement downwardly into a said cup member at said operating station and upwardly for removing said ramming member from said cup member during ejection of the depleted sample cake, and means for releasably secured said ramming member at said operating station on said piston member.

15. An extractor press according to claim 14, wherein said ejection means includes at said operating station another hydraulic cylinder having a piston member mounted for vertical displacement upwardly to lift the bottom end wall of the cup member and a depleted cake therewith.

16. An extractor press according to claim 15, wherein said hydraulic cylinders are in vertical alignment with each other.

17. An extractor press according to claim 8 or 14, wherein said compression means at each work station comprises a lower hydraulic cylinder having a piston member adapted to raise its receptacle and with its associated cup member, urging the sample in the associated cup member against its ramming member.

18. An extractor press according to claim 8, wherein said receptacles have slightly raised bottom walls whereby each said cup member is supported above the lowest part of the interior of said receptacle.

19. An extractor press according to claim 18, wherein said bottom walls of said cup members are movable mounted in their respective cup members, each said bottom wall being secured to an ejector rod depending therefrom, each said rod being selectively engageable with the piston member of said ejection means at said operating station.

20. An extractor press according to claim 9, wherein said locking means comprises a plurality of pivoted latch members each cooperable with a respective ramming member to maintain said ramming member in its compression position relative to its associated cup member.

21. An extractor press according to claim 11, said means for displacing comprising motor means for effecting the stepwise angular displacement of said drum relative to its axis of rotation.

22. An extractor press according to claim 20, further comprising locating means cooperable with said drum for ensuring the axial alignment of a said work station at said operating station subsequemnt to angular displacement of said drum.

23. An extractor press according to claim 13, wherein a central post defines means for supplying hydraulic fluid to all hydraulic cylinders for said compression means.

24. A method as defined in claim 1 including the step of transferring a portion of the precompression means with the first work station after the performance of step (a), and utilizing the transferred portion of the precompression means during the performance of step (e).

25. An extractor press according to claim 8 wherein said precompression means includes an element carried by each cup member.

26. An extractor press according to claim 8 wherein said precompression means includes an element carried by each cup member, and means for selectively coupling and uncoupling said element to a remainder of said precompression means at said operating station.

27. An extractor press according to claim 25 including means for releasably securing said element to said cup member.

28. An extractor press according to claim 26 including means for releasably securing said element to said cup member.

29. A press comprising at least two stations, means for conveying material from a first of said stations to a second of said stations, first and second means at said first station for imparting axially opposing precompression forces to material at said first station with the material disposed between said first and second force imparting means, said first force imparting means including first and second relatively separable means, said first separable means remaining at said first station and said second separable means and said second force applying means being conveyed by said conveying means to said second station, and said second separable means and said second force applying means imparting axially opposing compression forces to material at said second station with the material disposed between said second separable means and said second force applying means.

30. The press as defined in claim 29 wherein said first separable means includes a rod and said second separable means includes a head removably carried by said rod.

31. The press as defined in claim 30 wherein said second force applying means includes a second rod axially opposing said first rod.

32. The press as defined in claim 31 including a tubular member in axial alignment with said rods into which material is adapted to be deposited, and said tubular member being conveyed by said conveying means from said first station to said second station.

33. The press as defined in claim 32 wherein said tubular member includes aperture means therein from which a liquid portion can be extracted upon the compression of said material.

34. The press as defined in claim 32 wherein said rods are received in said tubular member.

35. The press as defined in claim 32 including means for removably securing said head to said tubular member.

36. The method as defined in claim 1 including the step of maintaining each sample under precompression during the performance of step (c).

37. The method as defined in claim 1 wherein step (b) is performed by directing a precompression force against the sample in a first direction and the compression portion of step (e) is performed by directing a compression force against the sample in a second direction axially opposite said first direction.

38. The method as defined in claim 37 including the step of maintaining each sample under precompression during the performance of step (c).

* * * * *